United States Patent [19]

McCormick

[11] Patent Number: 4,649,849

[45] Date of Patent: Mar. 17, 1987

[54] TOOL FOR CLEANING PROPELLER SHAFTS

[76] Inventor: Raymond S. McCormick, 15498 Golf Club Dr., Dumfries, Va. 22026

[21] Appl. No.: 716,204

[22] Filed: Mar. 26, 1985

[51] Int. Cl.[4] ..... B63B 59/00; B63B 59/08

[52] U.S. Cl. ..... 114/222; 15/236 R; 15/104.04; 30/172

[58] Field of Search .... 114/222; 15/236 R, 104.04 R, 15/235.4; 30/169, 172, 299

[56] References Cited

U.S. PATENT DOCUMENTS

| | | | |
|---|---|---|---|
| 725,811 | 4/1903 | Asbell | 30/299 |
| 804,921 | 11/1905 | Blackburn | 15/104.04 R |
| 1,083,099 | 12/1913 | Howg | 15/235.8 |
| 2,701,465 | 2/1955 | Johnson et al. | 72/136 |
| 2,944,275 | 7/1960 | Markusen | 15/236 R |
| 3,029,459 | 4/1962 | Pruitt | 15/235.4 |
| 3,719,993 | 3/1973 | Caprioli | 15/104.04 X |
| 4,375,709 | 3/1983 | Lewis | 15/235.4 |

*Primary Examiner*—Sherman D. Basinger

[57] ABSTRACT

An improved scraping tool is provided for removing barnacles from the propeller shafts of boats with inboard marine engines while the boat is in the water. The scraper is comprised of a curved metal blade with cutting edges on each end which engage substantially one-half of the periphery of the workpiece to remove the debris when moving the tool longitudinally in both directions to effect the desired scraping action. A handle is fastened longitudinally on the axis of the blade and centered on the body of the tool, to easily grasp and position the tool positively on the workpiece from a perpendicular position, and yet provide the leverage necessary to forcefully attack the barnacles. Whereas the handle of most other scrapers allow the operator to be positioned longitudinally at the end of the workpiece, due to the location of the propeller shaft and the associated equipment under a boat, the operator of this tool must be positioned perpendicular to the workpiece yet provide a longitudinal motion to effect the scraping action.

1 Claim, 4 Drawing Figures

TOOL FOR CLEANING PROPELLER SHAFTS

FIELD OF INVENTION

This invention relates to manually manipulated scrapers for quickly and efficiently removing accumulated marine growth such as barnacles from the underwater parts of marine propulsion systems, especially propeller shafts.

It is an object of my invention to provide a simple economical shaft scraper which is manually operated to quickly remove the accumulated marine growth (barnacles) from individual boat propeller shafts with a minimum of effort and scraping strokes, while the boat is in the water.

A further object is the provision of a handle equipped scraper blade conceived and constructed to employ longitudinal scraping edges on each end of the tool to remove accumulated marine growth from the propeller shaft when moving the tool in both forward and reverse directions along the shaft. The location of the propeller shafts in relation to the boat hull and shaft support struts, requires the user to approach the shaft from the side, but the tool must be used in a longitudinal direction.

Whereas my tool would be employed while the boat is in the water, the user of my tool would be under water where vision may be reduced; and would be employing my tool on the propeller shaft in the shadow of the boat above; and would be employing my tool on the propeller shaft of a boat riding at anchor but still subject to movement from wind and tide; therefore my tool has been conceived and constructed as an elongated metal tool which on the shorter side is arcuately formed to a curve which matches the curvature of the propeller shaft, and could be easily brought into exact alignment with the shaft and effectively operated under water.

BACKGROUND OF THE INVENTION

The pleasures of owning and operating marine craft having inboard engines are tempered by the problem of marine growth, more specifically barnacles, on the underwater hull and on the shaft transmitting power from the engine to the propeller attached to the end of the shaft.

Marine growth is most severe on craft operating in salt water. Anti-fouling coatings on the part of the hull which is underwater minimize or substantially eliminate such growth on those surfaces. A method of eliminating marine growth on the metal propeller shaft has not yet been found. The growth impedes the efficiency of the marine engines on such equipped craft because the build up of the growth causes excessive turbulence along the shaft, thereby reducing the efficiency of the associated propeller. To maintain maximum efficiency from the powered propulsion system, the marine growth should be removed every few weeks when the boat is in use. The usual procedure is to remove the craft from the water, or send a diver down to remove the growth while the craft is yet in the water.

At the present time, the principal tool used to remove marine growth from the propeller shaft is a putty knife. The steel in the putty knife blade is very durable and the thinness of the blade attacks the adhering marine growth very well. However, a putty knife is unwieldy and inefficient to use because of the placement of the handle in relation to the scraping edge, and because of the shape of the scraping edge. Because the blade of the putty knife is flat, but the shaft is round, the putty knife often slips off the shaft, frequently injuring the user, and ridges of marine growth are usually left on the shaft.

SUMMARY OF THE INVENTION

The present invention is an elongated piece of metal which is arcuately formed on the shorter side to a curve which matches the curvature of the shaft. A handle is affixed to the outer surface of the thusly formed tool.

BRIEF DESCRIPTION OF THE DRAWINGS

These and other objects and advantages of my invention will be apparent from the detailed description of a representative embodiment taken in conjunction with the accompanying drawings in which.

DETAILED DESCRIPTION OF MY INVENTION

Figure 1:
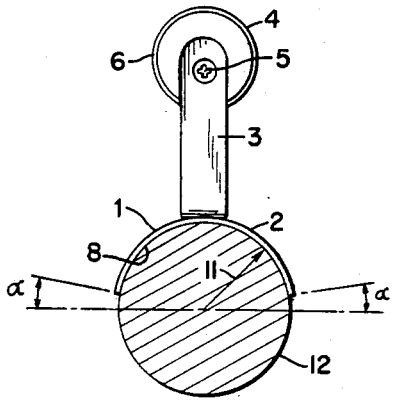
FIG. 1 is a front elevation view of one embodiment of my invention, the rear elevation view being substantially identical; the tool being positioned on a propeller shaft.
Figure 3:
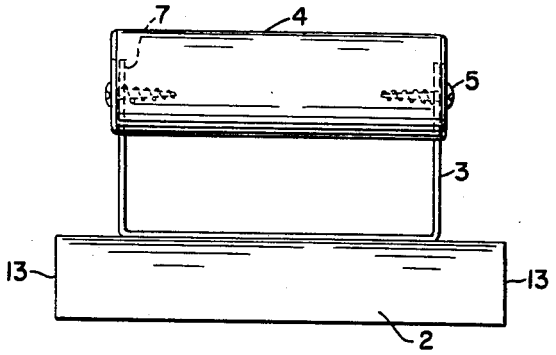
FIG. 3 is an elevation view in prospective.
Figure 2:
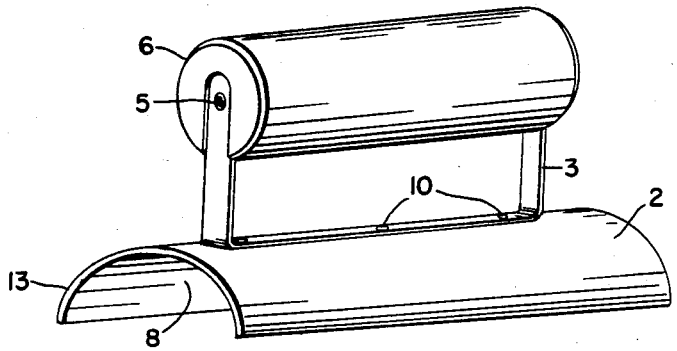
FIG. 2 is a right side elevation view of FIG. 1, the left side elevation view being substantially identical.
Figure 4:
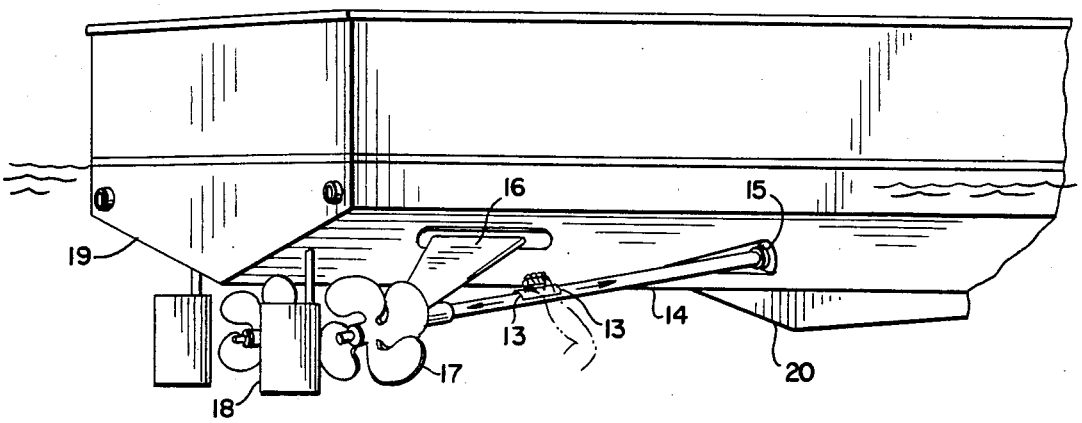
FIG. 4 is a perspective view illustrating the bottom of a boat, in the water, with related equipment, and showing the operation of my scraper on one of the propeller shafts.

FIGS. 1–3 illustrate the preferred embodiment of my invention, a propeller shaft cleaner having an arcuately formed scraping blade 1, to which outer surface 2, thereof is attached a bracket 3, to which handle 4, with rounded ends 6, is attached by screws 5. Preferably, the outer end portions of bracket 3, are fitted into recess 7, in each end of the handle 4. Bracket 3 is affixed to outer surface 2, by a plurality of spot welds 10, as seen in FIG. 3. The radius of curvature 11, of blade 1, is identical to the radius of the particular shaft 12, on which the tool is to be used. In FIG. 4, 9 is the water line, 19 is the hull of the boat, 15 is the shaft log (where the shaft penetrates the hull of the boat), 16 is the shaft support strut, 18 is the rudder, 17 is the propeller, 20 is the keel, and 14 is the propeller shaft with the dotted line indicating a human forearm and hand on the tool, and showing the scraping motion. The majority of propeller shafts on which the tool will be used have diameters in the range of 1 to 2 inches depending upon the size of the engine installed in the craft. The peripheral length of the arcuate segment of the tool will be in the range of an arc of 90 to 180 degrees with the preferred arc being 160 degrees as shown in FIG. 1 where angles ac are 10 degrees. The blade 1 is preferably formed from stainless steel having a thickness in the range of 1/64th to 3/64ths of an inch. The scraping edges 13, on the blade 1, are vertical, the thinness of the blade providing the necessary sharpness to dislodge the marine growth. The tool must be solidly constructed to withstand the impact of hitting the shaft log or propeller support strut.

My invention is especially suited for cleaning propeller shafts while the boat is in the water, thus eliminating the costs of dry-docking just for this purpose.

My invention can also be used for scraping propeller shafts when the boat is in drydock, providing a quicker more efficient use of labor for this purpose.

Because the tool has two opposed scraping edges, a shaft can be cleaned quickly using a back-and-forth motion. This is a very important timesaver when using the tool underwater. The matching curvature of the tool and shaft not only permits complete removal of the marine growth but eliminates the danger of injury because the entire surface of the tool remains in contact with the shaft. The lack of light under the boat, loss of visibility due to impurities in the water, and the confined workspace, make this tool especially suited for these conditions. Little effort is required to maintain full contact between the tool and the shaft.

From the foregoing description it will be seen that I have provided an extremely simple, sturdy tool for quickly and positively removing accumulated marine growth from the surface of boat propeller shafts while the boat is in the water.

What is claimed is:

1. A scraper for removing marine growth from an elongated cylindrical member such as the propeller shaft for a boat, comprising a rigid metal blade, said blade forming a section of a cylinder and having an arcuate inner and outer surface, said blade having a radius of curvature substantially identical to that of the propeller shaft to be scraped, said inner surface forming an arc of 90 to 180 degrees, said blade having two ends, each said end forming a scraping edge, said scraping edges each forming an arc of a circle and being substantially parallel with each other, a handle bracket, said handle bracket having an elongated central section and two outer end portions each with an end for fixing to a handle, said outer end portions being substantially perpendicular to said elongated central section, said elongated central section being directly fixed to the arcuate outer surface of said blade and extending intermediate the ends of said blade, a handle, said handle having two rounded ends, each said rounded end having a recess, each said recess receiving one of said ends for fixing to a handle.

* * * * *